United States Patent [19]

Patterson

[11] 4,163,506

[45] Aug. 7, 1979

[54] CLOSURE ASSEMBLY HAVING A TEAR TEMPLATE

[75] Inventor: Richard A. Patterson, Woodbury, Minn.

[73] Assignee: Minnesota Mining and Manufacturing Company, St. Paul, Minn.

[21] Appl. No.: 953,883

[22] Filed: Oct. 23, 1978

[51] Int. Cl.[2] ..... B65D 41/02

[52] U.S. Cl. ..... 220/260; 220/258; 220/271; 220/359

[58] Field of Search ..... 220/256–258, 220/260, 269–271, 359; 229/7 R; 222/541

[56] References Cited

U.S. PATENT DOCUMENTS

| | | | |
|---|---|---|---|
| 3,990,603 | 11/1976 | Brochman | 220/260 |
| 4,091,957 | 5/1978 | Moller | 220/260 |
| 4,108,330 | 8/1978 | Patterson | 220/260 |

*Primary Examiner*—George T. Hall

*Attorney, Agent, or Firm*—Cruzan Alexander; Donald M. Sell; Grady J. Frenchick

[57] ABSTRACT

A tear template is provided for use in an easy-open container closure system of the type employing an exterior tape and an interior sheet material. The tear template, which is located between the exterior tape and interior sheet material, advantageously provides a closure system which is better able to withstand excessive internal container pressures without detracting from the easy open character of the closure system.

16 Claims, 13 Drawing Figures

CLOSURE ASSEMBLY HAVING A TEAR TEMPLATE

BACKGROUND OF THE INVENTION

This invention relates to container closure assemblies employing two separate tapes. More particularly, this invention provides a tear template which permits clean opening of containers having tape closure assemblies.

U.S. Pat. No. 3,990,603 (Brochman), incorporated herein by reference, describes a particularly viable two-tape closure system which is used to seal a container having therein a carbonated beverage. Such patent describes the parameters which must be met by a two-tape easy open closure system having an exterior tape and an interior sheet material situated circumjacent (over and surrounding) a preformed opening (i.e. a pour hole) in a container end portion so that a gas-containing beverage may be contained during processing, storage, and up to the time of ultimate consumption of the beverage.

As a general matter, viable two-tape closure systems are a compromise between the desire to contain a pressurized beverage and the usually conflicting desire of having a closure system which can be easily opened by small children or weaker adults. The more aggressively the tapes are bonded to the beverage container, the more difficult the opening of the container becomes.

One of the problems that develops in balancing the aforementioned desires toward ease of opening is that of creep. When the closure system is designed so as to be more easily openable, such as by making the exterior tapes more easily removable, the potential for the tape to release slowly (that is, to "creep") from the container end portion during storage or shipment increases. As the exterior tape releases (usually in response to increased internal container pressure produced by an increase in ambient temperature ) it begins to bubble or bulge away from the container end in the area of the pour hole. Under the extremes of interior pressure occasionally encountered in the containment of carbonated beverages at high ambient temperatures, a bulge may become prominent enough so as to be esthetically displeasing or to significantly increase the chance it will be ruptured, thereby venting the container.

Although creep may be eliminated by more aggressively adhering the exterior tape and interior sheet material to the container end circumjacent the preformed opening therein, this makes opening of the container more difficult for children and weaker adults. The present invention provides means to aggressively adhere the exterior tape to the container end and yet produce a closure system which is easily hand opened.

SUMMARY OF THE INVENTION

The present invention provides, in one aspect, a tear template which initiates and directs the tearing of the exterior tape and also removes the interior sheet material during the operation of opening the container.

More particularly, the present invention provides in a hand operable, easy-opening closure system of the type wherein a flexible exterior tape and an interior sheet material are employed to removably seal a preformed opening in an end portion of a container, an improvement which comprises a flexible tear template, said template having a top surface and a bottom surface, said top surface being bonded to the underside of said exterior tape and said bottom surface being bonded to the top of said interior sheet material in the area of said preformed opening and being capable of (a) removing the portion of said interior sheet material in the area of said pour hole and (b) tearing an opening of predetermined shape in said exterior tape. In one embodiment (a) and (b) are accomplished simultaneously; in a second, sequentially. The present tear template is preferably attached to a removal means such as a grip tab, and preferably the exterior tape has means, such as serrations or nicks, along the leading edge thereof for initiating therein a longitudinal tear.

BRIEF DESCRIPTION OF THE INVENTION

The present invention is described in greater detail hereinafter with reference to the accompanying drawings wherein like reference characters refer to the same elements in the several views and in which.

DETAILED DESCRIPTION OF THE INVENTION

Figure 1:
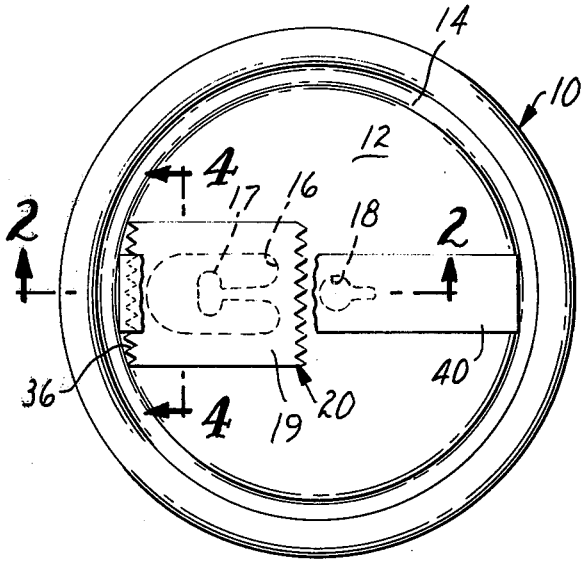
FIG. 1 is a top view of one embodiment of the present invention with a portion of the grip tab broken away to more clearly illustrate the invention.
Figure 2:
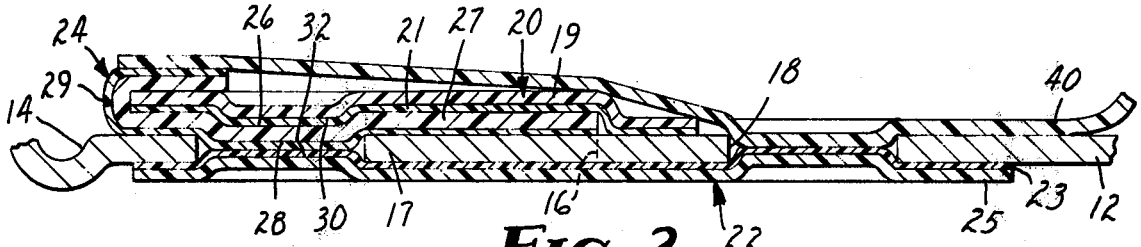
FIG. 2 is a cross-sectional view of the embodiment of the invention depicted in FIG. 1 taken along line 2—2.

Thus, in FIG. 1 there is shown a container end portion 10 (such as might be seamed onto a cylindrical, metal container body) comprising a generally circular, flat, rigid disc or lid 12 defined by an edge (or panel radius) 14, there being shown in phantom a preformed opening or pour hole 16 having therein a T-tab 17, and there being associated with said pour hole, a vent hole 18 (keyhole shaped herein), also shown in phantom. Such an end portion might be produced in large numbers as in a stamping operation. Situated exteriorly circumjacent (i.e., over and surrounding) preformed opening 16 there is an exterior tape 20. As is more clearly seen in FIGS. 2, 3 and 4, exterior tape 20 comprises a backing member 19 having adhesive 21 on one of its surfaces. Situated interiorly circumjacent preformed opening 16 and vent hole 18 there is an interior sheet material 22 which also comprises a backing 25 having an adhesive 23 on one of its surfaces. Between exterior tape 20 and interior sheet material 22 is a tear template 24 comprising a backing 27 having a top surface 26 and a bottom surface 28, said template having thereon a layer of adhesive 29. In the area of preformed opening 16, top surface 26 is bonded to the underside 30 of exterior tape 20 (by means of adhesive 21), and bottom surface 28 of template 24 is bonded to the top 32 of interior sheet material 22 (by means of adhesives 23 and 29). (In the embodiment shown, template 24 is also bonded to the exterior side of T-tab 17 in the area of preformed opening 16 by means of adhesive 29). Tear template 24 is bonded to said exterior tape 20 and to said interior sheet material 22 so as to be capable of removing the portion of the interior sheet material in the area of the preformed opening 16 while tearing an opening of predetermined shape in exterior tape 20.

The shape of the opening torn in exterior tape 20 is determined by the shape of the periphery of template 24. Where template 24 is rectangular, the shape of the opening in exterior tape 20 in the area of preformed opening 16 is essentially rectangular. Since it is generally desirable to remove the exterior tape from as much of the area of preformed opening 16 as is possible, the template is preferably the same width as preformed opening 16 so as to conveniently fit between its parallel longer sides. Between edge 14 and preformed opening 16, the shape of the opening torn in exterior tape 20 is determined by the manner in which the leading edge of the exterior tape (i.e., the edge of the exterior tape closest to edge 14) has been treated to provide ease of tear initiation. The "pinked" leading edge depicted tends to initiate tears which are colinear with the parallel sides of preformed opening 16 producing an elongated rectangular hole in exterior tape 20. Other shapes may be produced if, for example, outward opening or inward opening notches are cut in exterior tape 20. The shape of the opening torn in interior sheet material 22 should be the same as that of preformed opening 16 when the template is bonded to interior sheet material with sufficient aggressiveness.

During the operation of opening the container, grip tab 40 is pulled away from and across container end portion 10. The container is vented to ambient pressure when the portion of the interior sheet material 22 bonded to grip tab 40 in the area of vent opening 18 (by adhesive 23) is pulled through the vent hole 18.

Continuing with the opening operation, the grip tab 40, which is attached (by means of adhesive 29) to a portion of tear template 24 which is folded back upon exterior tape 20, directs the removing force against tear template 24. As the tear template is removed from container end 12, the tear template initiates a longitudinal tear in exterior tape 20 and simultaneously pulls a portion of interior sheet material 22 through preformed opening 16. The initiation of a longitudinal tear in exterior tape 20 is assisted by serrations 36 which are preferably present on the leading edge thereof, especially when thicker exterior tapes are employed. The serrations on the following edge of exterior tape 20 shown in FIG. 1 are not necessary to the embodiment invention shown in FIGS. 1–4 and are only depicted for clarity. (A continuous production of exterior tapes having serrations thereon generally requires the presence of serrations on both the leading and following edges of the exterior tape. The serrations on the following edge of the exterior tape are important in further embodiments of the invention discussed below, in which the leading edge serrations are not necessary.)

Continuing to open the container, the exterior tape, tear template and interior sheet material (the "closure assembly") engage the T-tab 17 which is bonded between the tear template and the interior sheet material. As the assembly is pulled toward the following edge of preformed opening 16, T-tab 17 is pulled out of the preformed opening and bends back toward the vent hole 18. Since container end portions generally take a set when folded, the closure assembly is biased away from the pour hole, the T-tab thereby preventing interference with the pouring operation. This concept of a T-tab biasing means is more completely described in a patent application entitled "Easy Open Container End Assembly", filed on June 8, 1977 in the name of Richard A. Patterson, now U.S. Pat. No. 4,108,330, incorporated herein by reference.

Figure 3:
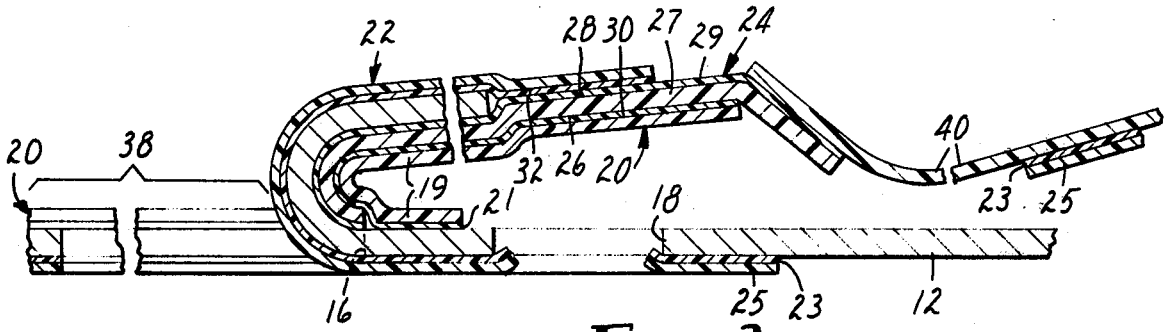
FIG. 3 is a cross-sectional view of the embodiment of the invention depicted in FIG. 1 as it would appear after the opening of the container.

After the closure assembly has been completely pulled across container end portion 10, the arrangement depicted in FIG. 3 results. Of particular note in FIG. 3 is the fact that a portion 38 of exterior tape 20 beside preformed opening 16 has not been removed from container end portion 10. The tear template 24 permits the easy opening of the container, while at the same time allowing exterior tape 20 to be very aggressively bonded to container end portion 10. Additionally, the portion 38 of exterior tape 20 which remains bonded to container end portion 10 covers the adhesive 21 used to bond exterior tape 20 to the container end. This presents a more appealing opened container and adds to the numerous advantages of the invention. Creep is lessened without reducing the ease with which the container may be opened, and at the same time a more appealing opened container end portion is provided.

Figure 4:
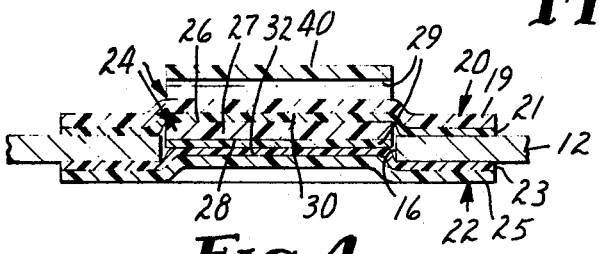
FIG. 4 is a cross-sectional view of the embodiment of container depicted in FIG. 1 taken along line 4—4.

FIG. 4 shows the "sandwich" of tapes, adhesives, and the template of the present invention. Proceeding from above, grip tab 40 is bonded to tear template 24 via adhesive 29. The exterior tape, which is comprised of backing 19 and adhesive 21 is bonded to tear template 24 by means of adhesive 21. Adhesive 21 also bonds exterior tape 20 to container end portion 12. Tear template 24 is bonded to the interior sheet material (which is comprised of backing 25 and adhesive 23) in the area of preformed opening 16 by means of adhesives 23 and 29. The production of this rather complex sandwich is discussed below.

FIGS. 5 through 7, 8 through 10, and 11 through 13 illustrate three additional embodiments of the present invention. These additional embodiments derive from the fact that, in each, the tear template is folded back upon itself to provide upper and lower portions which at least partially overlap, said upper portion being bonded to the underside of said exterior tape and said lower portion being bonded to the top side of said interior sheet material in the area of said preformed opening so as to be capable of removing the interior sheet material in the area of said pour hole. These additional embodiments are characterized by the features that the exterior tape is torn from the end of the exterior tape located adjacent the center of container end portion (rather than being torn from the end of the exterior tape adjacent the edge of the container end portion). Also, in the three additional embodiments the exterior tape and interior sheet material are sequentially torn rather than simultaneously torn as occurs in the embodiment of the invention depicted to FIGS. 1 through 4. Finally, in the embodiments of FIGS. 8 through 13, the separate center vent in the container end portion has been eliminated.

Figure 5:
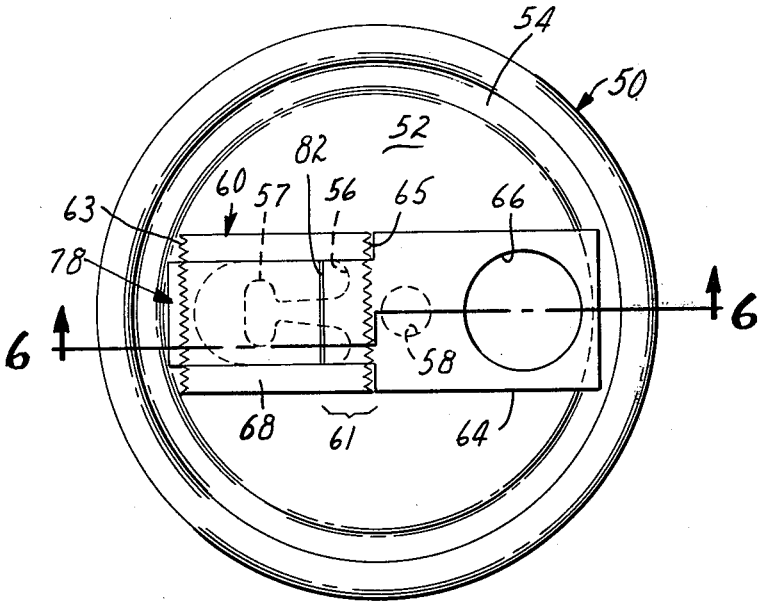
FIG. 5 is a top view of a second embodiment of the present invention.

Thus, in FIG. 5 there is shown a container end portion 50 comprising a generally circular, flat, rigid disk or lid 52 defined by an edge (or panel radius) 54 there being shown in phantom a preformed opening or pour hole 56 having therein a T-tab 57, and there being associated with said pour hole, a vent hole 58, also shown in phantom. Situated exteriorly circumjacent preformed opening 56 there is an exterior tape 60 which overlaps and is bonded to tear template 78 and a narrowed portion 61 of grip tab 64 which is the same width as tear template 78. Exterior tape 60 has serrations on the leading and following ends thereof, (63 and 65 respectively) and grip tab 64 has a finger hole 66 therein.

Figure 6:
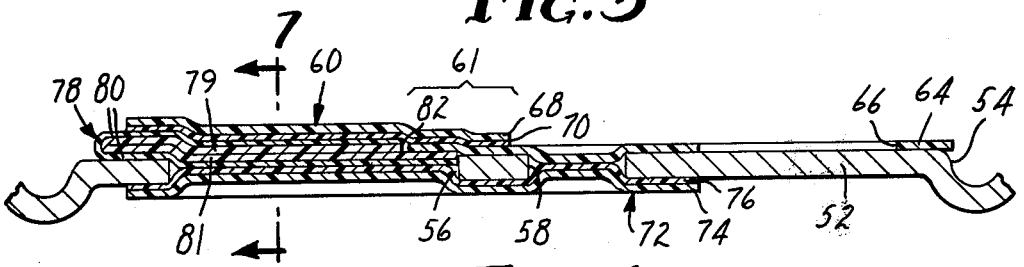
FIG. 6 is a cross-sectional view of the embodiment of the invention depicted in FIG. 5 taken along line 6—6.

In FIG. 6, exterior tape 60 is seen to comprise a backing member 68 having thereon an adhesive 70. As in FIGS. 2–4, interior sheet material 72 is situated interiorly circumjacent preformed opening 56 and comprises a backing 74 having thereon an adhesive 76. Between exterior tape 60 and interior sheet material 72 is a tear template 78 having thereon an adhesive 80. Tear template 78 is folded back upon itself to provide an upper portion 79 and a lower portion 81, upper portion 79 being bonded to the underside of exterior tape 60 (by adhesives 70 and 80) and the lower portion 81 of tear template 78 being bonded to the top of said interior sheet material 72 (by adhesives 76 and 80) in the area of preformed opening 56. In this embodiment, tear template 78 is folded back upon itself adjacent edge 54, (the lower portion 81 being partially overlapped by the upper portion 79) one end thereof being positioned so as to abut the narrowed portion 61 of grip tab 64 at juncture 82, the other end thereof being bonded to the underside of end portion 54 such that, upon opening, T-tab 57 is pulled out of preformed opening 56. In this manner a single adhesive 80 coated on an unfolded surface of said template can be used to bond the template to both the exterior tape and the interior sheet material.

Figure 7:
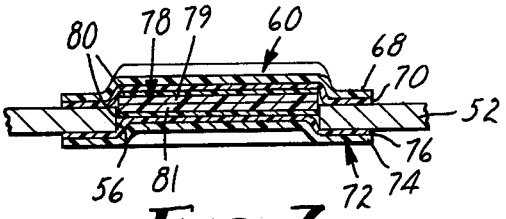
FIG. 7 is a cross-sectional view of the embodiment of the invention depicted in FIG. 5 taken along line 7—7 of FIG. 6.

FIG. 7 depicts the sandwich of backings and adhesives as they would appear if a cross-sectional cut along line 7—7 of FIG. 6 were made.

Opening of the container depicted in FIGS. 5, 6, and 7 is begun by placing a finger adjacent finger hole 66 in grip tab 64. Lifting away from container end portion 52, the container is vented to ambient pressure when the portion of interior sheet material 72 in the area of vent opening 58 is pulled through said vent opening. Continuing the opening operation, the narrowed portion 61 of grip tab 64 which is bonded to exterior sheet material 68 (by means of adhesive 70) engages serrations 65 and begin to tear exterior tape 60. At juncture 82 the composition of the narrowed portion 61 of grip tab 64 which abuts tear template 78 changes from a relatively inexpensive material used in the grip tab to a relatively more expensive, higher performance material as described in the examples below. (It is to be noted that the narrowed portion 61 of grip tab 64 is here performing the function of a tear template. While economics and performance characteristics generally dictate that the grip tab and tear template be comprised of different materials, a properly punched grip tab could have a portion which cooperates with the tear template to effectuate the desired results herein. Carrying the concept one step further, a one piece grip tab having a folded over tear template is within the contemplation of the present invention.) Continued application of removing force to grip tab 64 causes exterior tape 60 to be torn as described above, there being portions thereof left adhered to container end portion 52.

After the exterior tape has been torn from its following edge toward its leading edge (i.e., from adjacent the center of end portion 52 to the edge 53 thereof), the continued application of removing force begins to remove interior sheet material 72 in the area of preformed pour hole 56 which is bonded to the lower portion 81 of template 78. Interior sheet material 72 is torn through preformed pour hole 56 beginning at the leading edge thereof and continuing until the T-tab 57 is completely bent back out of the pour hole. At this point, the entire closure assembly is biased away from the pour hole by T-Tab 57, thereby minimizing closure assembly interference with the pouring and drinking operations.

Figure 8:
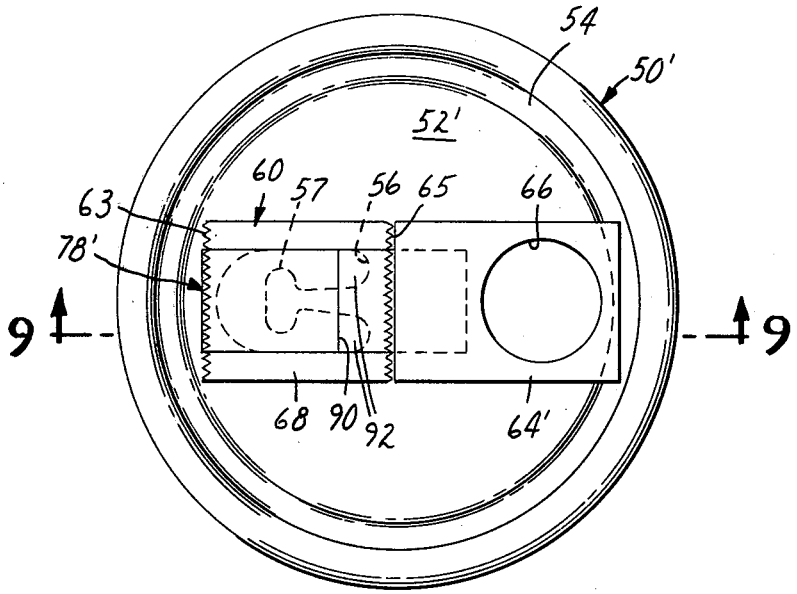
FIG. 8 is a top view of a third embodiment of the present invention.
Figure 9:
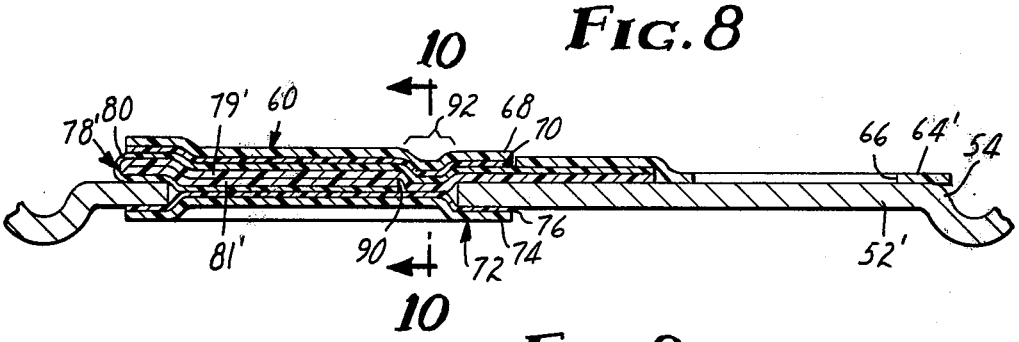
FIG. 9 is a cross-sectional view of the embodiment of the invention depicted in FIG. 8 taken along line 9—9.
Figure 10:
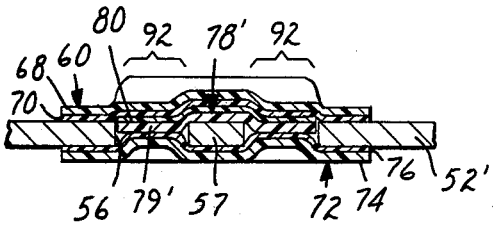
FIG. 10 is a cross-sectional view of the embodiment of the invention depicted in FIG. 8 taken along line 10—10 of FIG. 9.

FIGS. 8, 9 and 10 depict an embodiment of the present invention (50') that operates in much the same manner as the embodiment of FIGS. 5 through 7, the difference being that, as most clearly seen in FIG. 8, there is no separate vent hole in the container end portion 52'. In the embodiment of FIGS. 8, 9 and 10, tear template 78' is folded back upon itself (the upper portion 79' being partially overlapped by the lower portion 81') with the non-overlapped upper portion being bonded to the interior sheet material at area 92 which is bounded by the portions of the line 90 (the end of the lower portion of the tear template 78') falling in preformed opening 56 and the arcuate following edge of preformed opening 56. Venting of the container occurs when the portion of interior sheet material 72 which is bonded to the upper portion of template 78' is pulled through preformed opening 56 along the following edge of the preformed opening adjacent the proximal end of T-tab 57 (area 92).

Figure 11:
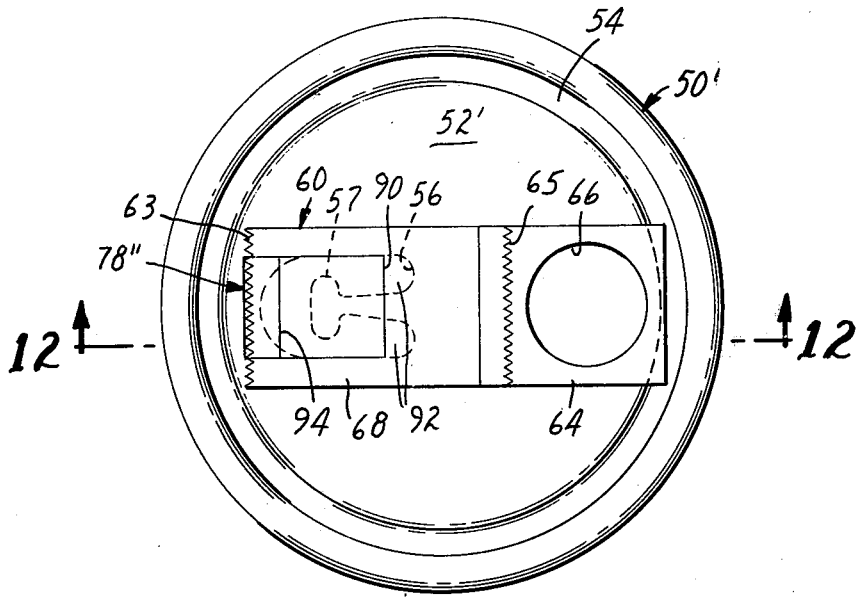
FIG. 11 is a top view of yet another embodiment of the present invention.
Figure 12:
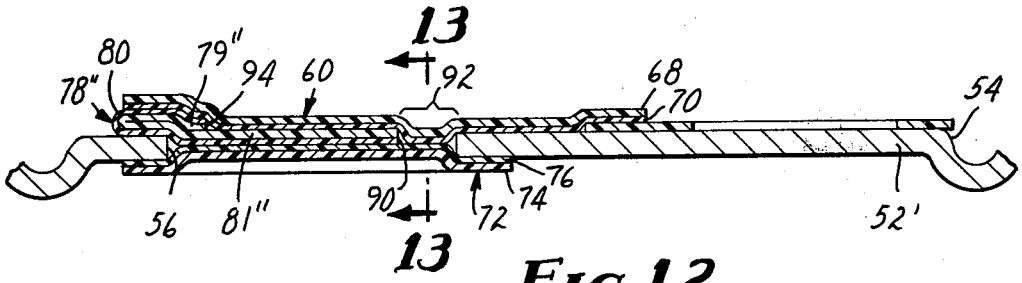
FIG. 12 is a cross-sectional view of the embodiment of the invention depicted in FIG. 11 taken along line 12—12.
Figure 13:
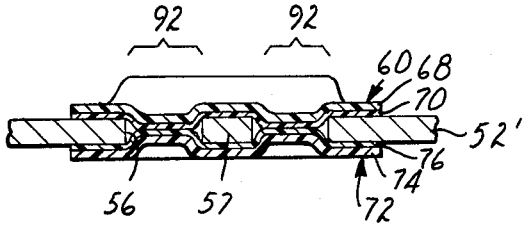
FIG. 13 is a cross-sectional view of the embodiment of the invention depicted in FIG. 11 taken along line 13—13 of FIG. 12.

FIGS. 11, 12 and 13 illustrate an embodiment (50'') of the present invention which is similar to the embodiments 50 and 50' with the exception that exterior tape 60 is completely peeled from container end portion 52'. In this embodiment, folded back upper portion 79'' only partially overlaps lower portion 81'', the non-overlapped lower portion being prevented from bonding to exterior tape adhesive 70 by coating on its exterior side of polyvinyl carbamate low adhesion backsize as describe in U.S. Pat. No. 2,532,011, incorporated by reference herein. The lower portion 81'' of template 78'' is bonded to interior sheet material 72 in the area of pour hole 56. As in embodiments of the invention 50 and 51', the container to which end portion 52' is attached is vented adjacent the proximal end of T-tab 57 in area 92. However, in this embodiment, venting is accomplished when the portion of the interior sheet material 72 bonded to exterior tape 60 is pulled through preformed opening 56. Continuing the opening operation, exterior tape 60 is peeled completely from container end portion 52', exterior tape 60 overlapping and being bonded to the upper portion of template 78'' starting at line 94. In the area of pour hole 56, exterior tape 60 is easily removed from the exterior side of the lower portion of template 78'' because its low adhesion backsize causes it to be but lightly tacked thereto. Template 78'' does not tear exterior tape 60 and only directs the removal of interior sheet material 72. This embodiment of the invention is particularly noteworthy in that the total number of layers in the "sandwich" (FIG. 13) has been reduced from the previously described embodiments. This is advantageous in that fewer layers permits the thermal bonding employed herein to be more easily accomplished.

With regard to the interior sheet material, U.S. Pat. No. 3,990,603, above, especially at Cols. 7 and 8, discusses the properties of suitable interior sheet materials which could be used in the present invention. That discussion is incorporated by reference herein.

The grip tab (40 and 64) may be comprised of any flexible (i.e., capable of being bent back upon itself) material which can be bonded to the tear template as well as to the interior sheet material in the area of vent hole (18 and 58). A particularly useful composite film for use in the grip tab comprises a layer of polyethyleneterephthalate (PET) and a copolymer layer of polyethyleneterephthalate (80)/polyethyleneisophthalate(20), preferably prepared by coextrusion, as taught in U.S. Pat. No. 3,871,947, incorporated herein by reference. Such a coextruded film is preferably pigmented by the incorporation therein of a small amount of a pigment such as carbon black.

Materials which may be used as the backing member (19 and 68) of the exterior tape (20 and 62) in the present invention generally have a caliper (thickness) in the range of about 1 to 5 mils (25 to 125 micrometers), with the preferred thickness being 1.5 to 3.5 mils (40 micrometers to 90 micrometers). Films which are thinner than the range specified have a tendency to bulge in response to the pressure generated by the carbonated beverage in the container. On the other hand, films which are thicker than the range specified tend to make the closure assembly too stiff. Excessive stiffness of the closure assembly tends to detract from its easy-open character and to increase its "creep". Additionally, to be useful, exterior tape backing member films should be dimensionally stable when exposed to bonding temperatures in the range of 450° F. (230° C.) to 550° F. (290° C.).

Particularly advantageous exterior tape backing members are those films which exhibit a preferred tear direction such as tending to tear in straight lines. Additionally, suitable exterior tape backing members should have a break tensile (discussed below) which is less than the break tensile of the tear template. This is particularly true where thinner, more friable exterior tape backing members are employed. Such thinner backing members may be employed without being treated (e.g., by scoring or pinking) to increase the ease with which tears may be initiated therein. Once a tear has been initiated in the exterior tape, all that is required of the tear template is that it be strong enough to propagate the initiated tear. Generally the tensile strength required of a tear template to propagate a tear in an exterior tape will be considerably less than the strength required to initiate a tear, and therefore tear templates having lower break tensile strength may be employed when the ease with which a tear may be initiated in the exterior tape has been increased by pinking or scoring.

Films which have been uniaxially or asymmetrically biaxially oriented (i.e., machine direction and transverse direction orientations are not equal) according to techniques well known in the art generally exhibit the property of tearing along preferred direction. Particularly preferred are uniaxially oriented films because such films generally tear anisotropically parallel to their axis of orientation. In order to take advantage of this property, a uniaxially oriented film exterior tape backing member should be positioned circumjacent the preformed opening (16 and 56) so that the axis of orientation of the film is parallel to the longest dimension thereof. Representative films which have been employed in the exterior tape backing member include uniaxially oriented polytetramethyleneterephthalate (PTMT) films having a thickness in the range of 1.0 mil (25 micrometer) to 3.5 ml (90 micrometer), the PTMT resin being commercially available from Tennessee Eastman Chemical Company under the trade designation "Tenite 6P4DF"; uniaxially oriented and biaxially oriented, pigmented (e.g., $TiO_2$) and unpigmented polyethyleneterephthalate (PET) films having a thickness in the range of about 1 mil (25 micrometers) to 4 mil (100 micrometer); and 2.0 mil, (50 micrometer) unoriented polyparabanic acid cast film (a non-heat sensitive film having oxalyl urea moieties connected by alkyl residues, such as the poly(parabanic) acid film commercially available from the Exxon Chemical Company under the trade designation "Tradlon". A particularly preferred exterior tape backing member is 3.5 mil, uniaxially oriented PTMT.

As illustrated in FIG. 1, one technique for improving the tear initiation character of the exterior tape is to cut teeth, or serrations along the edge from which a tear is to be initiated. It has been found that workable serrations generally have 5 to about 30 peaks per centimeter on the leading edge of the exterior tape with the longitudinal height of the peaks falling in the range of about 0.5 mm to about 1.0 mm. It appears that a workable serration generally should be quite regular, and therefore the random microjagged cuts produced by a knife having a scored, sand blasted cutting edge, such as described in U.S. Pat. No. 3,491,877, while workable, are not preferred. Another technique for improving the ease with which tears may be initiated in the exterior tape is to cut nicks or notches in the exterior tape backing member. Such notches or nicks should intersect the sides of tear template 24 in order for the template to propagate a tear initiated therefrom.

The characteristics of the flexible tear template herein are critical to the operation of the closure assembly of the invention. Functionally speaking, the tear template must have a tensile strength sufficient to initiate and propagate or direct the tearing of the exterior tape adjacent the preformed pour hole and to rupture and propagate the tearing of the interior sheet material to cleanly remove it from the preformed opening. Additionally, the tear template must be capable of being bonded to the interior sheet material with sufficient aggressiveness so that the template can rupture the interior sheet material along the leading edge of the preformed opening and continue to tear the interior sheet material along the inside edges of the preformed opening as the container is opened. Further, to prevent creep, the template must be aggressively bondable to the container end portion especially between its edge and the leading edge of the preformed opening. Lastly, the tear template must be attachable to a removal means, such as a grip tab, and be capable of being folded back upon itself or upon another film, in order for the tear template to be hand operated in the closure assembly.

Tear template materials which have generally been found to be useful herein are films having a tensile strength at break which is greater than about 7,000 psi (500 kg/cm$^2$) and a caliper in the range of about 1 to 5 mils (25 to 125 micrometers). Tensile strength of such useful films was measured using an "Instron" tensile tester, using ASTM D638 and D651 with a cross-head separation speed of 12 inches/min (30 cm/min). In order to achieve the requisite tensile strength, monofilament or multiple filament yarns, or reinforcements such as scrim or other woven or non-woven backings may be bonded to a flexible film. Other means of producing a flexible template having the requisite characteristics will be obvious to those skilled in the art.

It has been found that metallic, e.g., metal foil, materials may be used in the template. With such metallic materials are operable, for economic reasons, they are not preferred. Other materials which may be used in the template include all the exterior tape backing member films discussed above. The 3.5 mil (90 micrometer) uniaxially oriented PTMT film is a particularly preferred template material.

In another embodiment, a tear template comprised of parallel, multiple filament yarns has been employed. In this embodiment, the multiple filament yarns were placed interior the preformed pour hole parallel to and contiguous with the longest dimension (the sides) thereof. The yarns were sandwiched between the exterior tape and the container end portion and run to approximately ¼ inch (0.8 centimeters) beyond the leading edge of the pour hole toward the edge of the container end portion. Rather than using a plurality of serrations in the exterior tape, as described above, slits were cut into the exterior tape from the leading edge thereof, the slits being cut so as to intersect the yarns bonded therebeneath. Pulling on a grip tab opening of the closure assembly begins when the slits in the exterior sheet material are engaged by the yarns. Continuing the removing operation, at the point of engagement between the yarns and the slits, the yarns tear the exterior tape and exterior tape pulls the interior sheet material through the preformed opening. After complete opening of the container, the situation as depicted in FIG. 3 is much the same whether individual yarns are employed as a template or a continuous flat film is used. For the reason that individual yarns are difficult to position in a production situation, their use is not preferred.

In the following examples, a number of adhesives, primers, and priming techniques are discussed. These materials and techniques are also discussed in U.S. Pat. No. 3,990,603, above. The adhesive found to be most efficacious herein is a thermoplastic, linear, segmented block copolyester formed from isophthalic acid, terephthalic acid, 1,4-butanediol and polytetramethylene ether glycol. This adhesive is commecially available from the E. I. duPont de Nemours and Company under the trade designation "Dyvax PB 722." A particularly efficacious primer that is used herein is a phenyl terminated polycarbodiimide polymer which is disclosed in U.S. Pat. No. 4,060,664 the teachings of which are incorporated by reference herein.

EXAMPLE 1

A circular container end as depicted in FIG. 1 made from flexible sheet metal which takes a permanent set when folded (e.g., 0.013 inch (0.33 mm) thick single reduced tin free steel) was sealed incorporating therein the present invention. The container end portion 12 had the same pour hole and vent hole as depicted in FIG. 1.

An exterior tape employing a 3.5 mil (90 micrometers) uniaxially oriented, heat-set, polytetramethyleneterephthalate (PTMT) film backing, such as the PTMT film commercially available from the Tennessee Eastman Chemical Corporation under the trade designation "Tenite 6P4DF", was used as a backing member for the exterior tape. The PTMT film was corona treated to increase its receptivity to a primer. The corona treated side of the PTMT film then was primed with a polycarbodiimide primer (PCD) such as is described in U.S. Pat. No. 4,060,664, the teachings of which are incorporated herein by reference. The PCD primer is coated from a 2.5% total solids technical grade toluene solution to a dried coating thickness of about $2.5\times10^{-5}$ cm. The corona treated, primed backing then was extrusion coated with "Dyvax PB 722", to a coating weight of about 3.4 mg/cm$^2$. Lastly, the leading edge of exterior tape was "pinked" producing serrations having 30 peaks per centimeter and a longitudinal peak height of 1.0 mm.

Next a tear template was produced by corona treating a 3.5 mil (90 micrometer) PTMT film which was the same type of film as that used in the exterior tape. The corona treatment of the tear template was identical to the treatment of the exterior tape. Additionally the corona treated tear template was primed with the same PCD primer (to the same thickness) as was used with the exterior tape. The corona treated, primed backing then was extrusion coated with "Dyvax PB 722" (discussed above) to the same coating weight as that of the exterior tape. The overall dimensions of the template were 7/16 inches (1.1 cm) X 1⅛ inches (2.9 cm).

The grip tab employed herein is a coextruded 4 mil (100 micrometer) film having a layer of polyethyleneterephthalate (PET) and an adhesion promoting copolymer layer of 80% by weight polyethyleneterephthalate: 20% by weight polyethyleneisophthalate (PEI), the adhesion promoting layer being approximately 1/5 the total thickness of the grip tab film (i.e., 0.8 mil, 20 micrometers). The adhesion promoting layer of the coextruded grip tab film is incorporated into the final construction of the closure assembly so that it faces the backing side of the exterior tape and can be bonded to the folded back portion of the tear template.

The interior sheet material employed herein is an easy-tear, coextruded polyester film comprised of polyethyleneterephthalate and an 80% by weight polyethyleneterephthalate-20% by weight polyethyleneisophthalate layer, a total thickness of the bottom film being approximately 0.8 mil (20 micrometers). Here again the adhesion promoting layer (i.e., the 80:20 PET:PEI layer) comprises about 1/5 of the interior sheet material. The 80:20 PET:PEI layer of the interior sheet material is coated using a rotogravure coater with a phenyl terminated polycarbodiimide primer as described in U.S. Pat. No. 4,060,664. The dried thickness of the primer is about $2.5\times10^{-5}$ cm. The primed interior sheet material is then extrusion coated with "Dyvax PB 722" to a thickness of about 2.5 mil (63 micrometers) on the primer treated side. The opposite side of the backing (i.e., the 100% PET side) is then coated with a 0.1 mil (2.5 micrometers) dried coating thickness of a polyvinylidene chloride-ethyl acrylate-itaconic acid copolymer barrier coat such as that available from the W. R. Grace Company under the trade designation "Daran 220." The barrier coat reduces the gas permeability of the interior sheet material to gases such as carbon dioxide, oxygen, and water vapor.

Having constructed the interior sheet material, the tear template, the exterior tape, and the grip tab, the closure assembly is contructed as follows: A container end portion having therein the prepunched pour hole and center vent depicted in FIGS. 1–4 is employed. The container end was punched from 0.013 inch thick (0.33 millimeters) single reduced, tin free steel, such material being representative of materials which take a permanent set when folded.

The first step is to bond the interior sheet material to the underside of the container end portion over the prepunched pour hole and vent opening. The interior sheet material should be bonded at least ⅛ inch (0.3 centimeters) interiorly (i.e., interior its following edge) the vent hole and ⅛ inch (0.3 cm) exteriorly (i.e., exterior its leading edge) the pour hole. Bonding is accomplished by means of a heated platen press which employs a platen temperature of 400° F. (205° C.) a pressure of 80 lbs. per square inch (550 kPa) and a dwell time (i.e., bonding time) of 4 seconds. Next the tear template, which is the same width as the pour hole, is positioned over the pour hole on the top side of the container end portion. The template is then bonded to the interior sheet material in the area of the pour hole in all areas where the template and the sheet material are in contact. The tear template should not extend beyond the following edge of the pour hole. The template should extend to the edge 14 which defines circular portion 12 and then should be folded back upon itself approximately 5/16 inches (0.8 cm) thereby exposing the adhesive 29 to which the grip tab may be bonded. Next a grip tab of sufficient length (e.g., 2 inches, 5 cm) to extend to and cover vent hole 18 was bonded via adhesive 29 to the folded back portion of tear template 24 through the 80:20 PET:PEI layer of the grip tab. The width of the grip tab can be the same as that of the tear template (i.e., the width of the pour hole) but preferably is the same width as that of the exterior tape, i.e, ¾ inches (1.8 centimeters). The tear template should be bonded to the grip tab before the template is positioned over the pour hole, bonding conditions of 400° F. (205° C.) platten, 80 psi (550 kPa) and a 4 second bonding period being employed.

Having positioned the tear template-grip tab over the pour hole, the exterior tape is positioned over the top of the tear template. The exterior tape should be positioned so that it extends radially approximately ⅛ inch from the leading edge of the pour hole toward edge 14. This ⅛ inch projection is necessary in order to achieve a adequate bond between the exterior tape and container end 12. Additionally, the exterior tape should project centrally beyond the following edge of the preformed opening a minimum of about ⅛ inch, but should not cover the vent hole nor should it interfere with the subsequent bonding of the grip tab to the interior sheet material through the vent hole. Lastly, the exterior tape should extend a minimum of about ⅛ inch beyond the longer sides of the pour hole in oder to achieve a good bond between the exterior tape and the container end portion. In a typical carbonated beverage container, the exterior tape has the dimensions of 1 in (2.5 cm)×¾ in (1.9 cm).

Having positioned the exterior tape over the tear template and pour hole, the grip tab is folded into place over the exterior tape and positioned adjacent container end 12 over vent hole 18. In a single bonding step, the exterior tape is bonded to container end 12, the exterior tape is bonded to the interior sheet material 22 in the area of pour hole 16, (thereby sandwiching the template and the T-tab 17 between the two tapes), and the grip tab 40 is bonded to the interior sheet 22 in the area of the vent hole. This bonding is accomplished using a heated platen press with a platen temperature of 400° F. (205° C.), 80 lbs per square inch, (550 kPa) and a 4 second dwell time. After cooling, the container end assembly incorporating the present template provides the advantageous appearance and opening characteristics discussed above.

EXAMPLE 2

A 5 mil, (125 micrometer) medium hard, H-27 temper designation (American National Standard ANSI H35.1-1975 Revision of H35.1-1972) chromated aluminum foil, chromated by a proprietary conversion coating process employing a chromating solution such as that commercially available from the American Chemical Company under the designation "Aladine 1200" was employed as a tear template in the present invention. The chromated foil was primed with a polyurethane primer such as that commercially available from the Bakken Chemical Company under the trade designation "α841", the dried thickness of the primer being $1.5\times10^{-5}$ cm. The primed foil then was coated with "Dyvax PB722" to a thickness of 1 mil (25 micrometer). The adhesive coated primed foil template was then incorporated into a closure system and bonded to a container end portion having therein a preformed opening as described in Example 1.

The container end portion having thereon the closure assembly (in which the foil template was incorporated) was sealed onto a beverage container and pressurized. Upon opening of the pressurized container the aluminum foil template was found to tear the exterior tape so as to leave portions thereof beside the pour hole as well as cleanly removing the interior sheet material from the area of the pour hole.

What is claimed is:

1. In a hand operable easy opening closure system of the type wherein a flexible exterior tape and an interior sheet material are employed to removably seal a preformed opening in an end portion of a container, the improvement which comprises a flexible tear template, said template having a top surface and a bottom surface, said top surface being bonded to the underside of said exterior tape and said bottom surface being bonded to the top of said interior sheet material in the area of said preformed opening and being capable of removing the portion of said interior sheet material in the area of said pour hole and tearing an opening of predetermined shape in said exterior tape when said closure system is opened.

2. A closure system according to claim 1 wherein said template comprises a film having a thickness in the range of about 25 micrometers to about 125 micrometers and a break tensile strength of at least 500 kg/cm$^2$.

3. A closure system according to claim 1 wherein said template comprises a film having a thickness in the range of about 25 micrometers to 125 micrometers, said film comprising a polymer selected from the group consisting of polyethyleneterephthalate, polytetramethyleneterephthalate, or poly(parabanic) acid.

4. A closure system according to claim 1 wherein said template comprises metal foil having a thickness in the range of about 25 micrometers to 125 micrometers.

5. A closure system according to claim 1 wherein said template comprises a plurality of parallel yarns located parallel and contiguous with the longest dimension of said preformed opening.

6. A closure system according to claim 1 wherein said template comprises uniaxially oriented, heat-set, polytetramethyleneterephthalate film having a thickness in the range of about 25 micrometers to 125 micrometers, a length at least 3 mm longer than the sum of the length of the longest dimension of the preformed opening and the folded back portion of said template, and a width of approximately that of the preformed opening.

7. A closure system according to claim 1 wherein said predetermined shape conforms generally to the shape of said preformed opening.

8. A closure system according to claim 1 wherein said exterior tape has means for initiating therein a longitudinal tear.

9. A closure system according to claim 8 wherein said means for initiating a longitudinal tear comprises a plurality of serrations having a longitudinal height in the range of about 0.5 mm to 1.0 mm.

10. A closure system according to claim 1 which further comprises a removal means attached to said template.

11. A closure system according to claim 10 wherein said removal means comprises a grip tab.

12. In a hand operable easy opening closure system of the type wherein a flexible exterior tape and an interior sheet material are employed to removably seal a preformed opening in an end portion of a container, the improvement which comprises a flexible tear template, said template having a top surface and a bottom surface, said top surface being bonded to the underside of said exterior tape and said bottom surface being bonded to the top of said interior sheet material in the area of said preformed opening and being capable of removing the portion of said interior sheet material in the area of said pour hole and tearing an opening of predetermined shape in said exterior tape when said closure system is opened, there being a removal means attached to said template, said template comprised of uniaxially oriented, heat-set polytetramethyleneterephthalate film having a length of at least 3 mm longer than the sum of the length of the longest dimension of the preformed opening and the folded back portion of the template, and width of approximately that of the preformed opening and having a thickness in the range of about 90 micrometers with a break tensile strength of at least 500 $kg/cm^2$.

13. In a hand operable easy opening closure system of the type wherein a flexible exterior tape and an interior sheet material are employed to removably seal a preformed opening in an end portion of a container, the improvement which comprises a flexible tear template, said template being folded back upon itself to provide an upper portion and a lower portion which at least partially overlap, said upper portion being bonded to the underside of said exterior tape and said lower portion being bonded to the top side of said interior sheet material in the area of said preformed opening so as to be capable of removing the interior sheet material in the area of the pour hole.

14. A closure system according to claim 13 wherein said outer portion is bonded to said exterior tape so as to be capable of tearing an opening of predetermined shape therein.

15. A closure system according to claim 14 wherein said lower portion of said template is partially overlapped by said upper portion and the nonoverlapped lower portion of said template is bonded to a grip tab.

16. A closure system according to claim 14 wherein said upper portion of said template is partially overlapped by said lower portion and the nonoverlapped upper portion of said template is bonded to said interior sheet material adjacent the following edge of said preformed opening so as to be capable of venting said container.

* * * * *